US006102600A

United States Patent [19]

Bedol

[11] Patent Number: 6,102,600

[45] Date of Patent: Aug. 15, 2000

[54] GLUE STICK ASSEMBLY FOR USE WITH A STORAGE APPARATUS FOR A RINGED NOTEBOOK OR RINGED BINDER

[76] Inventor: Mark A. Bedol, 3423 Yankton Ave., Claremont, Calif. 91711

[21] Appl. No.: 09/207,426

[22] Filed: Dec. 8, 1998

Related U.S. Application Data

[63] Continuation-in-part of application No. 08/938,386, Sep. 26, 1997.

[51] Int. Cl.[7] ..... B43K 21/08; B43K 23/00; B42F 13/40

[52] U.S. Cl. ..... 401/88; 401/75; 402/4

[58] Field of Search ..... 401/88, 75, 175; 402/4

[56] References Cited

U.S. PATENT DOCUMENTS

| | | | |
|---|---|---|---|
| 1,039,296 | 9/1912 | Krumming | 281/30 X |
| 1,308,437 | 7/1919 | Metcalfe | 281/30 |
| 1,894,241 | 1/1933 | Raynolds | 402/80 L |
| 1,904,572 | 4/1933 | Trussell | 402/4 |
| 2,097,626 | 11/1937 | Lesti | 402/4 |
| 2,160,392 | 5/1939 | Schade | 129/1 |
| 2,184,823 | 12/1939 | Vernon | 129/1 |
| 2,194,003 | 3/1940 | Brooks | 281/3 |
| 2,200,146 | 5/1940 | Block | 281/30 |
| 2,223,560 | 12/1940 | Friedlaender | 281/31 |
| 2,276,987 | 3/1942 | Kengott | 129/4 |
| 2,318,192 | 5/1943 | Boelema, Jr. | 281/31 |
| 2,453,459 | 11/1948 | Roberts | 129/4 |
| 2,505,694 | 4/1950 | Stuercke | 129/4 |
| 2,647,517 | 8/1953 | Bilbrey | 129/1 |
| 2,673,099 | 3/1954 | Hamilton | 281/15 |
| 2,704,077 | 3/1955 | Prillaman | 129/1 |
| 2,821,197 | 1/1958 | Bilbrey | 129/1 |
| 3,126,891 | 3/1964 | Caputi | 129/1 |
| 3,366,118 | 1/1968 | Beyer | 129/4 |
| 4,157,757 | 6/1979 | Gallaher, Jr. | 206/328 |
| 4,430,015 | 2/1984 | Nerlinger | 402/79 |
| 4,555,018 | 11/1985 | Cho | 206/214 |
| 4,580,920 | 4/1986 | Schmidt | 401/175 |
| 4,595,309 | 6/1986 | Chinchar | 402/80 R |
| 4,704,042 | 11/1987 | Eisen et al. | 402/79 |
| 4,820,071 | 4/1989 | Steinfield et al. | 402/4 |
| 4,909,652 | 3/1990 | Harrison | 402/80 R |
| 4,918,632 | 4/1990 | York | 364/708 |
| 5,058,736 | 10/1991 | Bedol | 206/214 |
| 5,118,138 | 6/1992 | Brotz | 281/51 |
| 5,118,213 | 6/1992 | Merservy et al. | 402/80 R |
| 5,209,592 | 5/1993 | Bedol | 402/1 |

(List continued on next page.)

FOREIGN PATENT DOCUMENTS

| | | | |
|---|---|---|---|
| 835316 | 12/1938 | France | 402/4 |
| 64148 | 10/1955 | France | 402/4 |
| 1396190 | 3/1965 | France | 402/4 |
| 2575419 | 7/1986 | France | 402/80 R |
| 817440 | 10/1951 | Germany | 402/4 |
| 17022 | 7/1909 | United Kingdom | 402/4 |
| 7081 | 3/1910 | United Kingdom | 281/30 |
| 11652 | 5/1912 | United Kingdom | 281/30 |
| 217484 | 6/1924 | United Kingdom | 402/4 |
| 1564220 | 4/1980 | United Kingdom | 281/30 |

OTHER PUBLICATIONS

NiteOwl™ lighted notepad, Lumatec Industries, Inc., PO Box 279 Austin, Texas 78767–9830. Owner's Manual plus two photographs of device.

*Primary Examiner*—Henry J. Recla
*Assistant Examiner*—Peter deVore

[57] ABSTRACT

A ringed notebook or ringed binder and having spaced grasping arms. The glue stick assembly includes a cylindrical housing assembly with an outer diameter in a range of between 0.38 and 0.58 inches. The cylindrical housing assembly is securable by spaced grasping arms of the storage apparatus. A glue stick is positioned within the cylindrical housing assembly. The glue stick assembly enhances the modular characteristics of the storage apparatus.

6 Claims, 4 Drawing Sheets

U.S. PATENT DOCUMENTS

| | | | |
|---|---|---|---|
| 5,316,341 | 5/1994 | Schwartz | 281/15.1 |
| 5,409,319 | 4/1995 | Bedol | 402/1 |
| 5,460,414 | 10/1995 | Sargis | 281/38 |
| 5,476,336 | 12/1995 | Osiecki et al. | 402/79 |
| 5,498,089 | 3/1996 | Motyka | 402/4 |
| 5,503,489 | 4/1996 | Maudal | 402/80 L |
| 5,570,964 | 11/1996 | Bedol | 401/75 |
| 5,597,256 | 1/1997 | Burton et al. | 402/4 |
| 5,604,268 | 2/1997 | Randen et al. | 523/164 |
| 5,605,572 | 2/1997 | Berger | 118/241 |
| 5,695,294 | 12/1997 | Bedol et al. | 402/79 |
| 5,839,843 | 11/1998 | Bedol | 402/4 |

GLUE STICK ASSEMBLY FOR USE WITH A STORAGE APPARATUS FOR A RINGED NOTEBOOK OR RINGED BINDER

This application is a Continuation-In-Part of application Ser. No. 08/938,386 filed on Sep. 26, 1997.

BACKGROUND OF THE INVENTION

1. Field of the Invention

The present invention relates to inserts for ringed notebooks and ringed binders and, more particularly, to a glue stick assembly for use with a storage apparatus of the type which is positionable within the volume formed within the rings of the notebook or binder, for storing various selected items.

2. Description of the Related Art

Users of notebooks, including businessmen and students, often desire to have various articles such as pencils and pens at their easy disposal when they use their notebook and to be secure from being lost when they carry their notebooks from one location to another.

In partial solution to this problem, present applicant Mark A. Bedol, invented a "Notebook Organizer Including Slidable Element", U.S. Pat. No. 5,050,736. The U.S. Pat. No. 5,050,736 patent discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

Present applicant Mark A. Bedol, has also invented "Notebook Insert With Calculator and Holepunch", U.S. Pat. No. 5,209,592, which discloses a notebook insert comprising a housing, an electronic calculator attached to the housing and a holepunch assembly also attached to the housing. The housing has a periphery with multiple holes therethrough which are spaced to be adapted for engagement with the rings of a ringed notebook.

Although these prior art devices are effective in attempting to maximize the usable space within a notebook, they have not exploited the volume within the rings of the notebook.

Present applicant, Mark A. Bedol, is also a co-applicant of U.S. Pat. No. 5,695,294, entitled, "Storage Apparatus for a Ringed Notebook or Ringed Binder" which discloses and claims a storage apparatus having a storage item receiving element which includes spaced arms for grasping selected items. As noted in the '294 patent, the selected item could include a glue stick which is illustrated; however, not described in detail. The use of grasping arms to support a glue stick is also described in present applicant's co-pending U.S. Ser. No. 08/938,386 where again the glue stick is not described in detail. As will be disclosed below, the present application is directed to a glue stick assembly which is particularly adapted for use with the storage apparatus discussed in the aforementioned applications.

OBJECTS AND SUMMARY OF THE INVENTION

It is, therefore, a principal object of the present invention to provide optimal utilization of all of the space within a ringed notebook or ringed binder.

It is another object to provide a glue stick assembly which furthers these objects.

These and other objects are achieved by the present invention which is a glue stick assembly for use with a storage apparatus. The storage apparatus is of the type used for a ringed notebook or ringed binder and having spaced grasping arms. The glue stick assembly includes a cylindrical housing assembly with an outer diameter in a range of between 0.38 and 0.58 inches. The cylindrical housing assembly is securable by spaced grasping arms of the storage apparatus. A glue stick is positioned within the cylindrical housing assembly. The glue stick assembly enhances the modular characteristics of the storage apparatus.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE PREFERRED EMBODIMENTS

Figure 1:
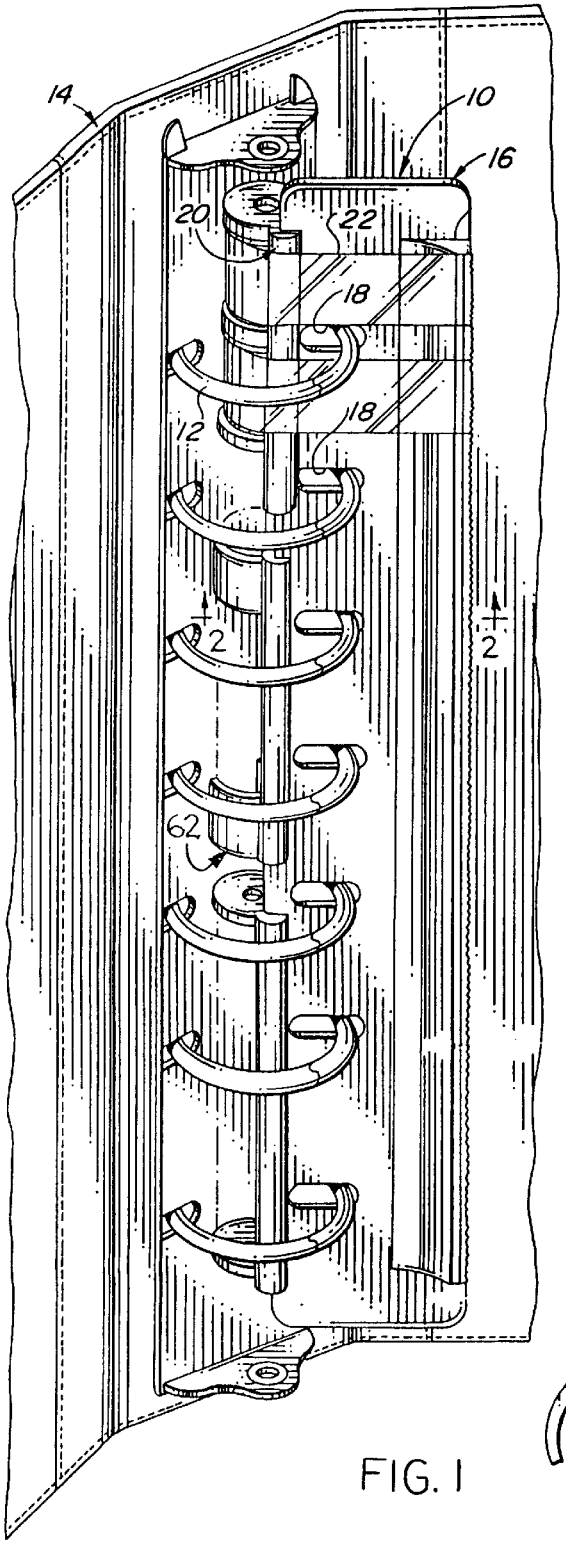
FIG. 1 is a front perspective view of a storage apparatus, utilized with a seven-hole ringed notebook, the storage apparatus containing the glue stick assembly of the present invention.

Referring now to the drawings and the characters of reference marked thereon, FIG. 1 illustrates the environment in which the glue stick assembly 62 of the present invention operates. The glue stick assembly 62 is shown used with an embodiment of the storage apparatus disclosed and claimed in present applicant's herein-before mentioned U.S. Pat. No. 5,695,294 and U.S. Ser. No. 08/938,386, the storage apparatus being designated generally as 10, shown attached to the rings 12 of a conventional ringed binder, designated generally as 14. The subject matter of U.S. Pat. No. 5,695,294 and U.S. Ser. No. 08/938,386 is hereby incorporated herein by reference. The apparatus 10 includes a thin main plate member, designated generally as 16 having a plurality of spaced openings 18 therethrough (in this instance seven openings 18). The openings 18 are arranged and sized so as to accommodate the rings 12 of a ringed notebook or a ringed binder. Storage means, as indicated generally as 20, is utilized to store a selected item, for instance, as shown in FIG. 1, a roll of tape 22, or a glue stick assembly 62 of the present invention. The storage means 20, as will be explained in detail below, extends from the main plate member 16 into the volume formed within the rings 12 so that the volume, which is normally unused, can be utilized to store the selected item, i.e., tape 22.

Figure 7:
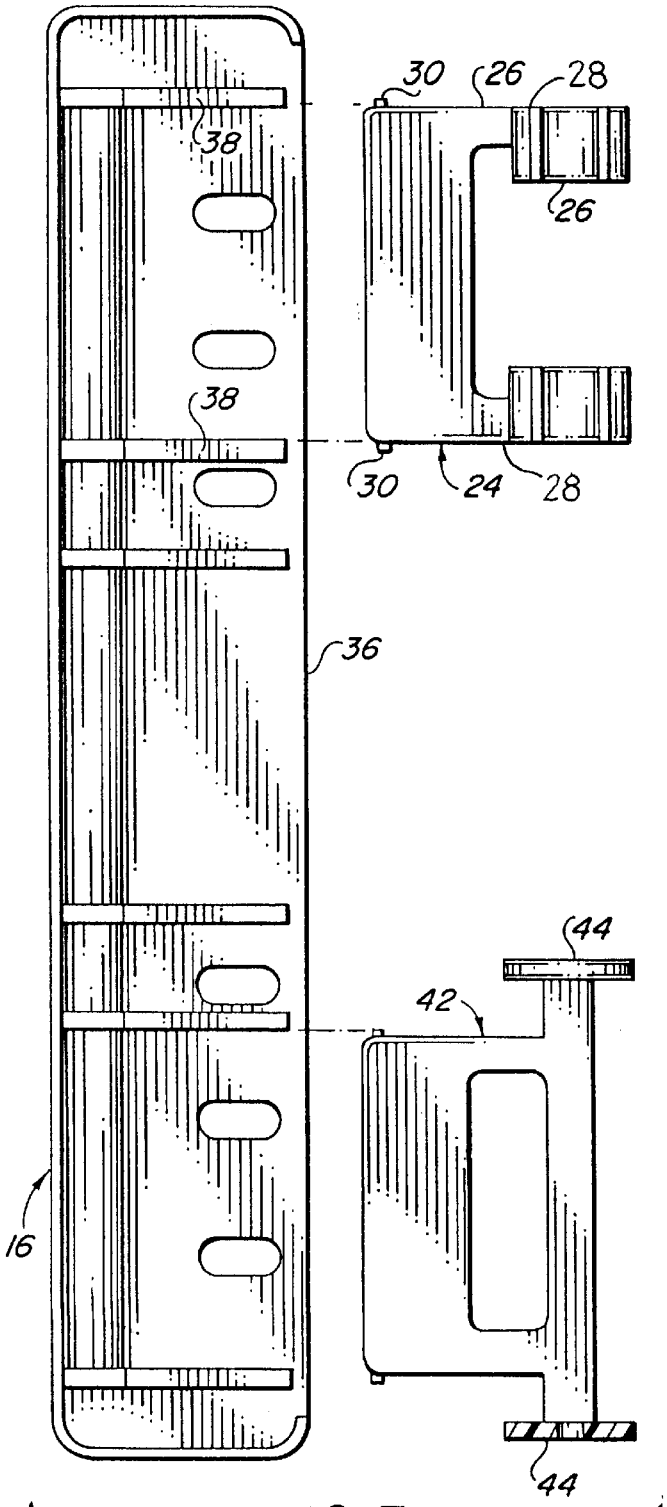
FIG. 7 is a rear plan view of another embodiment of the storage apparatus in which the main plate member has six holes to accommodate a similarly designed six-hole ringed notebook, this view showing how the snap on holder, which may be used to retain the glue stick assembly, becomes secured.

In further illustrating the environment in which the assembly 62 of the present invention operates, referring now to FIG. 7, a type of storage means 20 is shown, which involves use of a snap on holder, designated generally as 24. The snap on holder 24 includes a storage plate member 26, locking means, and spaced arms 28, i.e., a storage item receiving element 28. The storage item receiving element 28 extends from a first end of the storage plate member 24 wherein during use of the apparatus 10, the storage item receiving element 28 extends into the volume formed within the rings.

The locking means comprises a pair of tabs 30 on a second end of the storage plate member 24 for engagement with tab reception elements formed on a rear surface of the main plate member 16. The locking means also preferably includes an edge receiving tab element positioned on the storage plate member 24 for engagement with a portion of the edge 36 of the main plate member 16. Thus, by use of the locking mechanism described, the snap on holder 24 can be securely positioned on the main plate member 16. Movement in the orthogonal direction is prevented by the guideways 38 formed on the main plate member 16.

Figure 2:
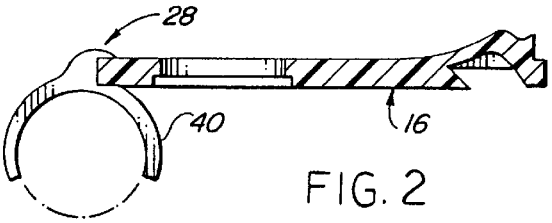
FIG. 2 is a view taken along Line 2—2 of FIG. 1.
Figure 8:
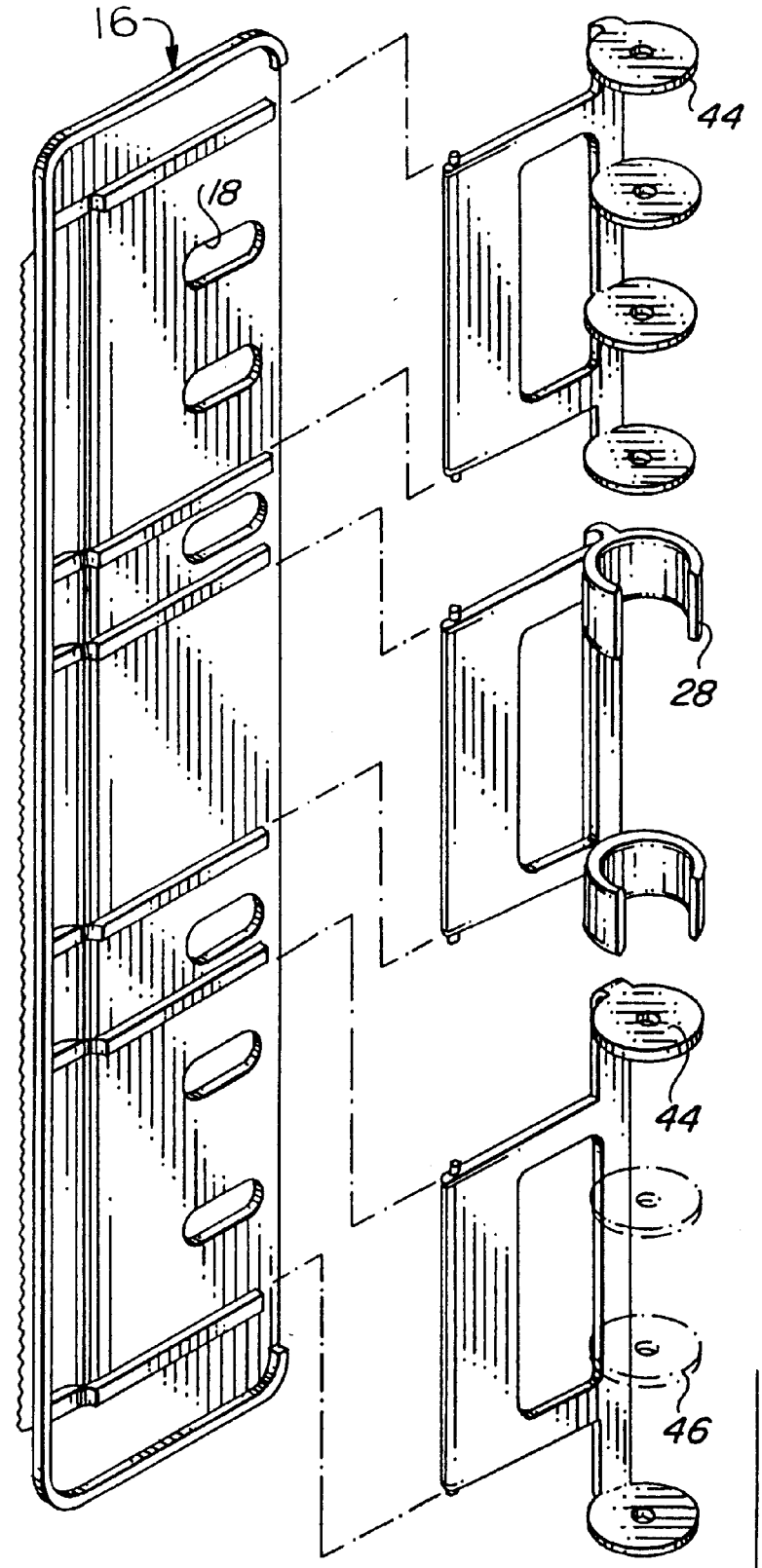
FIG. 8 is a rear perspective view of the six-hole main plate member utilized with a variety of snap on holders.

The storage item receiving element disclosed in present applicant's '294 patent and the '386 patent application may comprise different embodiments. For example, the storage item receiving element 28 comprises a pair of spaced, somewhat U-shaped cylinder receiving elements (i.e. spaced arms) 40 (best seen in FIG. 2) for receiving the selected item, the selected item in this instance being the glue stick assembly 62 of the present invention. In the lower part of FIG. 7, a second type of storage item receiving element is illustrated, designated generally as 42 which can hold other devices. Element 42 comprises a pair of opposed spaced, circular reel receiving elements. Each element 44 has a central opening 46 therethrough for receiving a post of a reel. The reel may contain a variety of materials, such as, for example, tape or paper. FIG. 8 illustrates the multi-configurable aspects of the storage apparatus and the utility of the glue stick assembly of the present invention.

Figure 3:
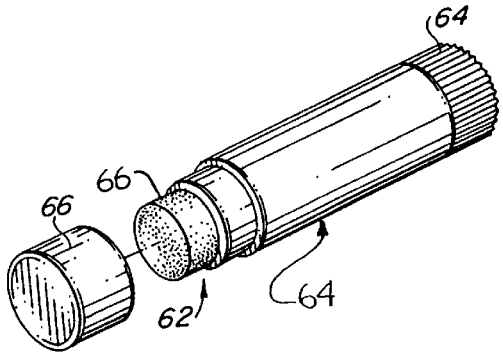
FIG. 3 is a perspective view of a glue stick assembly of the present invention which can be stored utilizing the storage apparatus shown in FIGS. 1 and 2.
Figure 5:
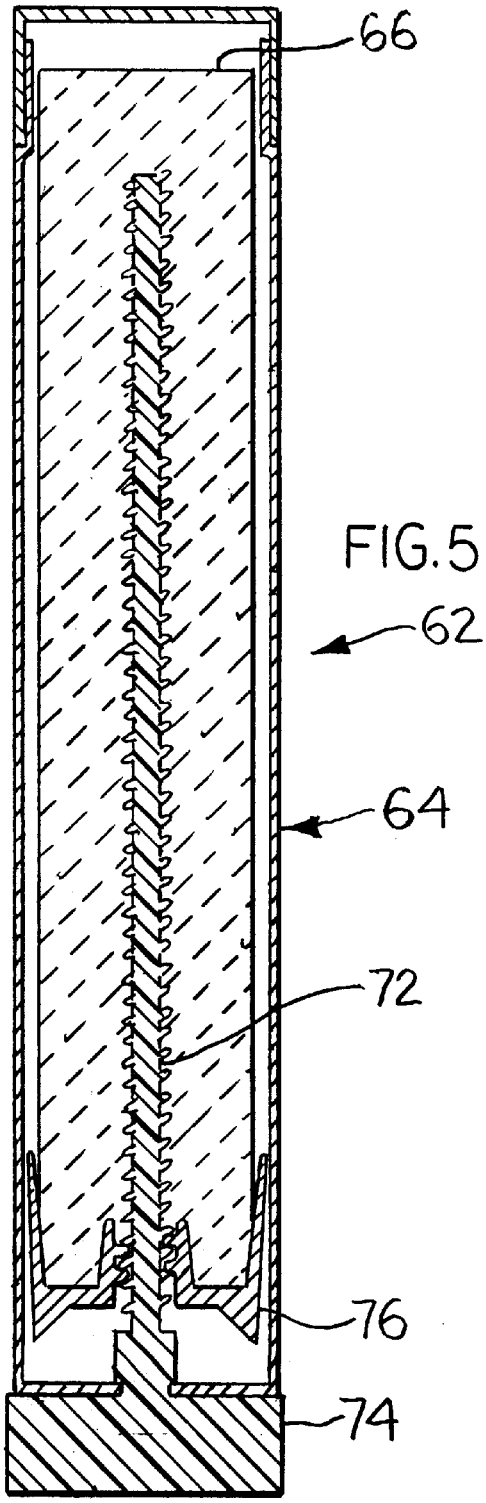
FIG. 5 is a cross-sectional view of the glue stick assembly.
Figure 4:
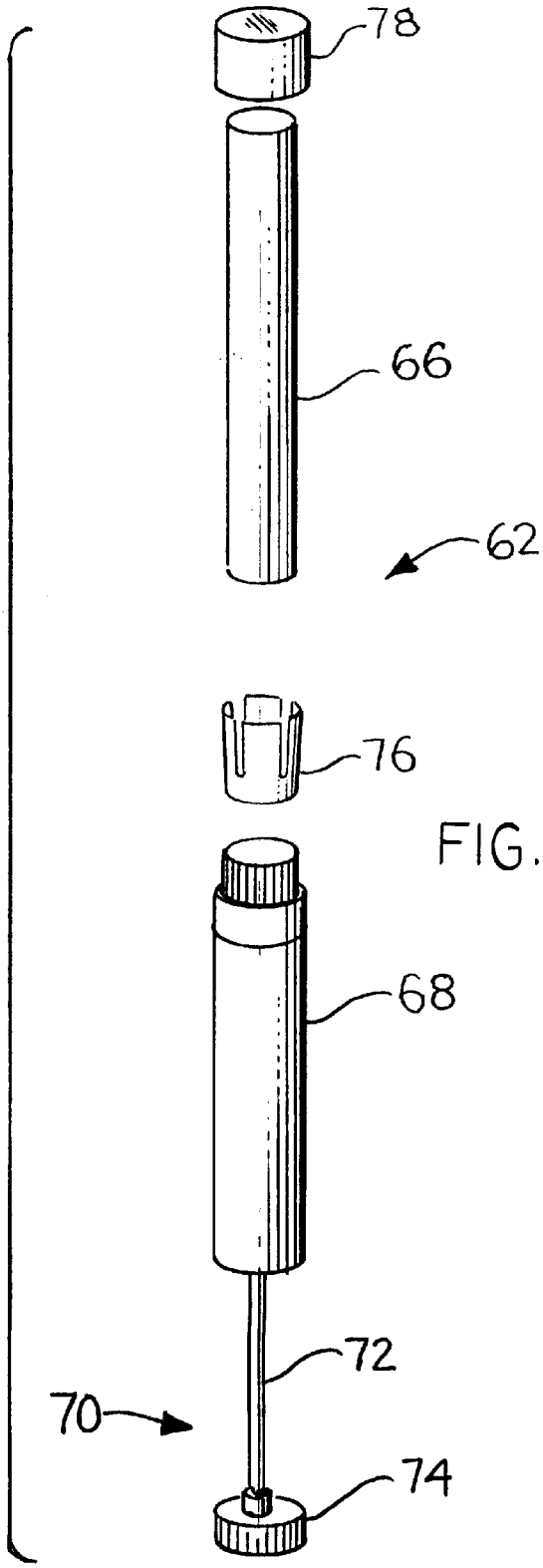
FIG. 4 is an exploded perspective view of the glue stick assembly.

Referring now to FIGS. 3–5, a preferred embodiment of the glue stick assembly 62 of the present invention is illustrated. The glue stick assembly 62 includes a cylindrical housing assembly, designated generally as 64, and a glue stick 66. The cylindrical housing assembly 64 has an outer diameter in a range of between 0.38 and 0.58 inches. It is securable by the spaced grasping arms of the storage apparatus. Assembly 64 includes a hollow cylinder 68 and a rotatable actuator assembly, designated generally as 70, positioned within the hollow cylinder 68. The rotatable actuator assembly 70 includes a screw element 72 affixed to a knob 74. It also includes a carriage 76 with a central opening for providing threadable engagement with the screw 72. The rotatable actuator assembly 70 repositions the glue stick 66 relative to the hollow cylinder 68 to compensate for loss of glue as the glue stick assembly is operated. A cap 78 is positioned over the hollow cylinder 68.

The cylindrical housing assembly has a total length of less than 3 inches, preferably about 2.5 inches. In fabrication of the glue stick assembly 66, the glue is poured as a liquid into the cylinder 68.

Figure 6:
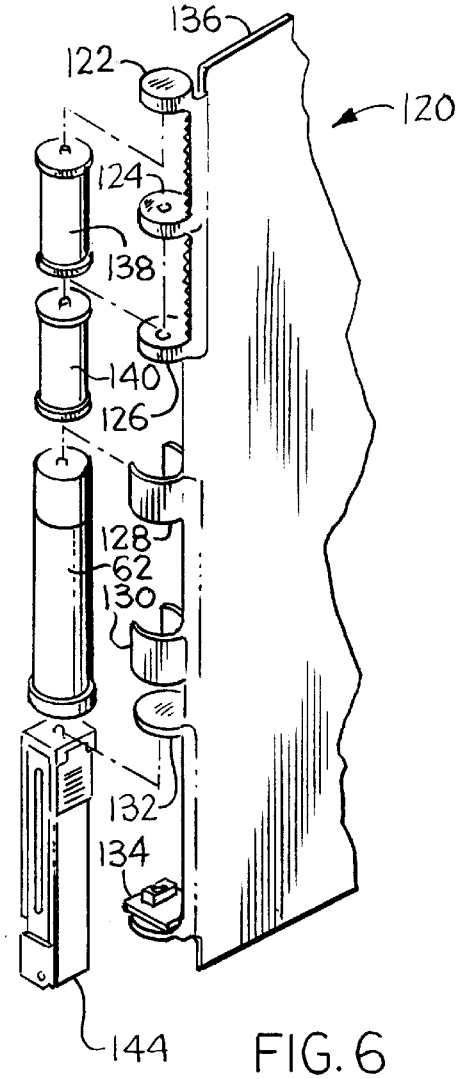
FIG. 6 is a perspective view of a storage apparatus, highlighting the modular nature of the storage assembly of which the glue stick assembly of the present invention is an integral part thereof.

Referring now to FIG. 6, another embodiment of the storage assembly is illustrated, designated generally as 120. (Storage assembly 120 was disclosed and claimed in U.S. Ser. No. 08/938,386.) In this embodiment, the various grasping arms 122, 126, 128, 130, 132, and 134 are integrally connected to the main plate member 136. Various items may be supported by the grasping arms such as, for example, tape rollers 138, 140; a stapler 144; and, the glue stick assembly 62 of the present invention.

Obviously, many modifications and variations of the present invention are possible in light of the above teachings. It is, therefore, to be understood that within the scope of the appended claims, the invention may be practiced otherwise than as specifically described.

What is claimed and desired to be secured by letters patent of the united states is:

1. A glue stick assembly/storage apparatus for a rinsed notebook or ringed binder. comprising:

a) a storage apparatus comprising a pair of substantially U-shaped spaced grasping arms; and b) a glue stick assembly comprising:

a cylindrical housing assembly having an outer diameter in a range of between 0.38 and 0.58 inches said cylindrical housing assembly being securable by said spaced grasping arms of the storage apparatus; and a glue stick positioned within said housing assembly.

2. The glue stick assembly/storage apparatus of claim 1, wherein said cylinder housing assembly comprises a hollow cylinder and a rotatable actuator assembly positioned within said hollow cylinder for repositioning said glue stick relative to said hollow cylinder to compensate for loss of glue as the glue stick assembly is operated.

3. The glue stick assembly/storage apparatus of claim 2, wherein said rotatable actuator assembly comprises a screw element affixed to a knob.

4. The glue stick assembly/storage apparatus of claim 3, further including a cap positionable over said hollow cylinder.

5. The glue stick assembly/storage apparatus of claim 1, wherein said cylindrical housing assembly has a length of less than 3 inches.

6. The glue stick assembly/storage apparatus of claim 1, wherein said cylindrical housing assembly has a length of approximately 2.5 inches.

* * * * *